US012752325B2

(12) United States Patent
Ito et al.

(10) Patent No.: US 12,752,325 B2
(45) Date of Patent: Oct. 6, 2026

(54) FORGED STEEL ROLL FOR COLD ROLLING

(71) Applicant: NIPPON STEEL CORPORATION, Tokyo (JP)

(72) Inventors: Seiji Ito, Tokyo (JP); Yoshiki Takahama, Tokyo (JP); Kaho Hirayama, Tokyo (JP); Hakuei Hirokawa, Tokyo (JP); Kazuya Hanaori, Tokyo (JP); Tomoaki Sera, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 332 days.

(21) Appl. No.: 18/578,578

(22) PCT Filed: Aug. 3, 2021

(86) PCT No.: PCT/JP2021/028833
§ 371 (c)(1),
(2) Date: Jan. 11, 2024

(87) PCT Pub. No.: WO2023/012906
PCT Pub. Date: Feb. 9, 2023

(65) Prior Publication Data

US 2024/0383025 A1 Nov. 21, 2024

(51) Int. Cl.

| | |
|---|---|
| ***B21B 27/02*** | (2006.01) |
| ***C21D 1/18*** | (2006.01) |
| ***C21D 6/00*** | (2006.01) |
| ***C21D 8/00*** | (2006.01) |
| ***C21D 9/36*** | (2006.01) |
| ***C22C 38/00*** | (2006.01) |
| ***C22C 38/02*** | (2006.01) |

(Continued)

(52) U.S. Cl.
CPC ..... *B21B 27/02* (2013.01); *C21D 1/18* (2013.01); *C21D 6/002* (2013.01); *C21D 6/004* (2013.01); *C21D 6/005* (2013.01); *C21D 6/008* (2013.01); *C21D 8/00* (2013.01); *C21D 9/36* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/32* (2013.01); *C22C 38/42* (2013.01); *C22C 38/44* (2013.01); *C22C 38/46* (2013.01); *C22C 38/48* (2013.01); *C22C 38/54* (2013.01)

(58) Field of Classification Search
CPC ..... C22C 38/00; C22C 38/54; B21B 27/00; B21B 27/02
See application file for complete search history.

(56) References Cited

U.S. PATENT DOCUMENTS 8,920,296 B2 * 12/2014 Gaspard ..... C22C 38/22 148/334
2021/0205918 A1 7/2021 Fujii et al.

FOREIGN PATENT DOCUMENTS

CN 110904302 A 3/2020
JP 46-38896 B1 11/1971

(Continued)

*Primary Examiner* — Jason L Vaughan
(74) *Attorney, Agent, or Firm* — Birch, Stewart, Kolasch & Birch, LLP

(57) ABSTRACT

Provided is a forged steel roll for cold rolling with a Vickers hardness Hy at 400° C. of 400 or more.

4 Claims, 1 Drawing Sheet

(51) Int. Cl.

| | |
|---|---|
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/32*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/54*** | (2006.01) |

(56) References Cited

FOREIGN PATENT DOCUMENTS

| | | | |
|---|---|---|---|
| JP | 56-42665 | B2 | 10/1981 |
| JP | 61-213349 | A | 9/1986 |
| JP | 1-234548 | A | 9/1989 |
| JP | 2-185928 | A | 7/1990 |
| JP | 5-86439 | A | 4/1993 |
| JP | 5-132738 | A | 5/1993 |
| JP | 2010-242166 | A | 10/2010 |
| WO | WO 2017/154658 | A1 | 9/2017 |

* cited by examiner

FORGED STEEL ROLL FOR COLD ROLLING

FIELD

The present invention relates to a forged steel roll for cold rolling.

BACKGROUND

In general, a forged steel or another iron-based material is used as a roll for cold rolling. In cold rolling using such a forged steel roll for cold rolling, for example, along with long term use, the roll surface gradually decreases in roughness and therefore slip occurs between the roll and rolled material during rolling making rolling impossible or the film of lubrication oil supplied between the roll and steel sheet breaks, etc., due to changes in the rolling conditions, etc., resulting in the roll and steel sheet directly contacting and sticking sometimes occurring. Further, slip or sticking or other sheet conveyance problems subject the roll surface to thermal shock and, due to such thermal shock, cracks sometimes initiate in the roll surface. If leaving such cracks as they are, the cracks will gradually propagate in the roll. If the cracks propagate, the outer surface of the roll will sometimes peel away. Such a phenomenon of roll damage is generally called "spalling".

In relation to this, to prevent spalling and other roll damage, to prevent cracks from subsequently propagating if such cracks initiate in a roll, the practice has been to grind down the roll surface corresponding to the depth of the cracks so as to remove the cracks. However, if cracks deepen, the amount ground down for removing the cracks becomes greater, therefore there is the problem that the specific roll consumption (kg/ton) (amount of grinding down of roll (kg)/amount of rolling of product (ton)) deteriorates. Therefore, there is a need for a roll for cold rolling having a high crack resistance enabling the initiation of cracks due to thermal shock to be suppressed or reduced, in particular a forged steel roll for cold rolling.

PTL 1 describes a method for producing a work roll for metal rolling mill comprising casting a steel containing C: 0.7 to 1.0%, Si: 0.15 to 1.5%, Mn: 0.15 to 1.5%, Cr: 3.0 to 6.0%, Mo: 3.0 to 5.0%, and V: 1.2% or less, heating the casted material to a temperature of the transformation point or more at only the surface layer part, spraying it with water to quench it, then processing it by sub-zero treatment at a temperature of −30° C. or less and further tempering it at a temperature of 180° C. or more. PTL 1 describes that according to the above method for production, if making the surface hardness similar to that of a conventional roll, the tempering temperature can be made 40° C. or more higher, therefore there is the effect of remarkably improving the resistance to cracks due to thermal shock at the time of rolling problems.

PTL 2 describes a high toughness roll for rolling use containing, by weight percent, C: 0.45 to 0.95%, Mn: 1.0% or less, Cr: 4.5 to 6.0%, Mo: 0.3 to 0.7%, Ni: 0.6 to 2.0%, and a balance of Fe and unavoidable impurities, and keeping down a content of Si as an unavoidable impurity to less than 0.1%. PTL 2 describes that in a conventional roll material based on Cr—Mo steel, by keeping down a content of Si to 0.1% or less as an unavoidable impurity and including Ni in 0.6 to 2.0%, it is possible to obtain a roll material for rolling use having a high toughness while securing a level of hardness the same as a conventional roll, i.e., without damaging the wear resistance, spalling resistance, and thermal shock crack resistance.

PTL 3 describes a work roll material for cold rolling made of forged steel containing C: 0.90 to 1.10 wt %, Si: 0.5 to 1.0 wt %, Mn: 0.1 to 1.0 wt %, Cr: 4.0 to 6.0 wt %, Mo: 3.0 to 6.0 wt %, V: 0.5 to 2.0 wt %, Co: 1.0 to 3.0 wt %, and a balance of Fe and unavoidable impurities. PTL 3 describes that according to the above constitution, it is possible to obtain a work roll material for cold rolling provided with both wear resistance and thermal shock resistance—considered difficult to achieve in the past.

PTL 4 describes a quenched roll for rolling use consisting of, by wt %, C: 0.7 to 1.4%, Si: 0.8 to 2.5%, Mn: 0.8 to 2.5%, Ni: 0.5 to 2.5%, Cr: 2.5 to 6.5%, Mo: 2.5 to 8.5%, W: 0.3 to 3.0%, V: 0.5 to 4.5%, and a balance of Fe and unavoidable impurities, and including an amount of retained austenite formed due to tempering after sub-zero treatment in 15% to 40%. PTL 4 describes that the toughness is improved and propagation of cracks after crack initiation is prevented by making the amount of retained austenite remain in a range of 15 to 40%.

PTL 5 describes a forged steel cold rolling roll containing, by mass %, C: 0.6 to 1.2%, Si: 0.4 to 0.8%, Mn: 0.4 to 1.0%, Ni: 0.4 to 1.0%, Cr: 3.0 to 6.0%, Mo: 0.2 to 0.5%, and a balance of Fe and unavoidable impurities, wherein an average particle size of carbides dispersed in a metal structure of a roll surface part within 50 mm from the roll surface is 1 μm or less and an area fraction of the dispersed carbides is 5 to 30%. PTL 5 describes that according to the above forged steel cold rolling roll, it is possible to secure excellent toughness even without using expensive microalloys or other elements or employing a special process and that no cracks initiate at the time of rolling even at the time of a high load environment.

CITATIONS LIST

Patent Literature

[PTL 1] Japanese Unexamined Patent Publication No. 2-185928

[PTL 2] Japanese Unexamined Patent Publication No. 1-234548

[PTL 3] Japanese Unexamined Patent Publication No. 5-086439

[PTL 4] Japanese Unexamined Patent Publication No. 5-132738

[PTL 5] Japanese Unexamined Patent Publication No. 2010-242166

SUMMARY

Technical Problem

The mechanism behind the initiation of cracks in a roll for cold rolling due to thermal shock has not been clarified in the past. The inventors thought, as one possibility, that cracks at the roll surface initiate in the following way. First, when the temperature of the roll surface rises for an instant due to thermal shock and the temperature is more than a certain value, the microstructure is tempered. Along with tempering of the microstructure, shrinkage of the material occurs at the roll surface. Next, due to the shrinkage of the material, tensile stress is caused at the roll surface. Due to such tensile stress, cracks initiate at the roll surface.

From the above viewpoint, it is believed that to suppress or reduce the initiation of cracks at a roll surface due to thermal shock, increasing the hardness of the roll material at the high temperature at the time of the thermal shock so as to improve the durability of the roll surface against tensile stress occurring along with shrinkage of the material at such a high temperature is an effective solution. The above PTLs 1 to 5 study the chemical composition and method for production of the roll material, but do not study the suppression or reduction of initiation of cracks due to thermal shock from the viewpoint of increasing the hardness of the roll material at a high temperature.

The present invention was made in consideration of the above and has as its object the provision of a forged steel roll for cold rolling improved in crack resistance able to reduce the initiation of cracks due to thermal shock.

Solution to Problem

The present invention to achieve the above object is as follows:

(1) A forged steel roll for cold rolling with a Vickers hardness Hv at 400° C. of 400 or more.

(2) The forged steel roll for cold rolling according to the above (1), having a chemical composition comprising, by mass %, C: 0.70 to 1.50%,
Si: 0.40 to 1.50%,
Mn: 0.20 to 1.50%,
P: 0.030% or less,
S: 0.0200% or less,
Al: 0.050% or less,
N: 0.0200% or less,
O: 0.0050% or less,
Cr: 2.80 to 8.00%,
Mo: 0.30 to 3.00%,
Cu: 0.100% or less,
B: 0.0100% or less,
Ni: 0 to 1.20%,
V: 0 to 2.00%,
Nb: 0 to 1.00%, and
balance: Fe and impurities, and
satisfying the following formula 1:

$$4.50 \leq Cr + Mo + V + Nb \leq 14.00 \quad \text{formula 1}$$

wherein the contents (mass %) of the elements entered in the symbols of the elements in formula 1, and 0 is entered in the case where the elements are not included.

(3) The forged steel roll for cold rolling according to the above (2), wherein the chemical composition contains, by mass %, at least one selected from the group consisting of:

Ni: 0.05 to 1.20%,
V: 0.10 to 2.00%, and
Nb: 0.10 to 1.00%.

(4) The forged steel roll for cold rolling according to any one of the above (1) to (3), wherein a shrinkage start temperature in a temperature elevation process is 300° C. or more.

Advantageous Effects of Invention

According to the present invention, by using as a roll for cold rolling a roll produced from forged steel with a Vickers hardness Hv at 400° C. of 400 or more, it is possible to remarkably suppress or reduce the initiation of cracks at the roll surface. That is, it is possible to remarkably improve the crack resistance of a roll for cold rolling. By using such a forged steel roll for cold rolling, even if slip or sticking or other sheet conveyance problems at the time of cold rolling cause thermal shock to be applied to the roll, it is possible to make the cracks initiate due to the thermal shock shallower. For this reason, it is possible to reduce the amount of grinding of the roll for removing the cracks and therefore remarkably improve the specific roll consumption.

DESCRIPTION OF EMBODIMENTS

Forged Steel Roll for Cold Rolling

Figure 1:
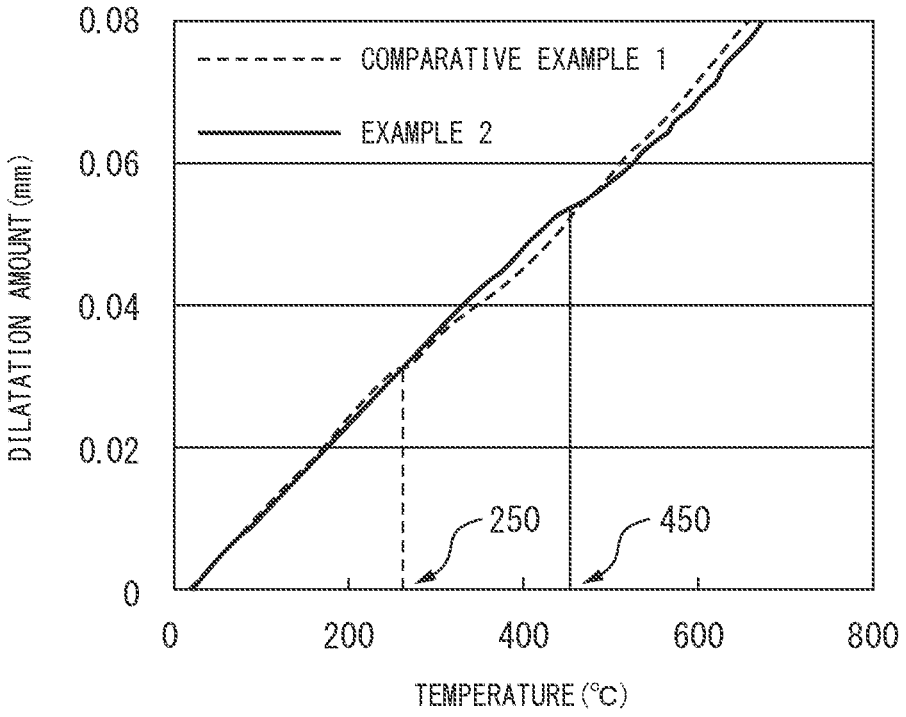
FIG. 1 is a graph showing thermal dilatation curves of roll materials in a temperature elevation process using a Formaster tester for explaining a shrinkage start temperature according to the present invention.

The forged steel roll for cold rolling according to an embodiment of the present invention has a Vickers hardness Hv at 400° C. of 400 or more.

In cold rolling using a forged steel roll, slip or sticking or other sheet conveyance problems occurring between the roll and rolled material during rolling subject the roll surface to thermal shock and, due to this, cracks sometimes initiate in the roll surface. If the cracks propagate, peeling called "spalling" will sometimes occur at the outer surface of the roll.

The inventors took note of the hardness of a roll material at a high temperature as an indicator of durability against crack initiation at the roll surface due to thermal shock and investigated the correlation between the hardness of the roll material and the initiation of cracks. As a result, the inventors discovered that by using as a roll for cold rolling a roll produced from forged steel having a Vickers hardness Hv at 400° C. (below, also simply referred as "high temperature hardness") of 400 or more, it is possible to remarkably suppress or reduce the initiation of cracks at the roll surface, i.e., remarkably improve the crack resistance of a roll for cold rolling. By using such forged steel roll for cold rolling, even when slip or sticking or other sheet conveyance problems at the time of cold rolling cause thermal shock to be applied to the roll, it is possible to make the cracks initiate due to the thermal shock shallower. In relation to this, it is possible to reduce the amount of grinding of a roll for removing cracks and therefore remarkably improve the specific roll consumption.

Vickers Hardness Hv at 400° C. (High Temperature Hardness)

A forged steel roll for cold rolling according to an embodiment of the present invention has a Vickers hardness Hv at 400° C. of 400 or more. In general, the higher the temperature reaches, the more the hardness of the roll material decreases. In relation to this, the inventors discovered that in a conventional forged steel roll for cold rolling, the hardness decreases rapidly at a high temperature of near 400° C. Further, the inventors discovered that by making the chemical composition a suitable one while specially modifying the method of production, it is possible to maintain the Vickers hardness Hv of the forged steel roll for cold rolling at a high level of 400 or more even at such a high temperature. According to an embodiment of the present invention, by controlling the Vickers hardness Hv at 400° C. of the forged steel roll for cold rolling to such a range, it is possible to obtain a high durability against tensile stress occurring at the roll surface at the high temperature at the time of thermal shock and as a result becomes possible to remarkably suppress or reduce the initiation of cracks at the roll surface due to the thermal shock.

The higher the Vickers hardness Hv at 400° C. of the forged steel roll for cold rolling, the higher the durability of the roll surface to tensile stress. The Vickers hardness Hv at 400° C. is preferably 410 or more, more preferably 420 or more, still more preferably 430 or more, most preferably 435 or more or 440 or more. The upper limit value of the Vickers hardness Hv at 400° C. is not particularly prescribed, but even if making the high temperature hardness excessively high, sometimes the effect of suppression or reduction of the initiation of cracks will become saturated and on the other hand loss of the toughness will be caused. Therefore, the Vickers hardness Hv at 400° C. is preferably 700 or less and may be 600 or less, 550 or less, or 500 or less.

Here, "400° C." means the temperature of the roll surface. The "Vickers hardness Hv" means the Vickers hardness of a region from the surface of the body part of the roll down to a depth of 10 mm. In the present embodiment, the "Vickers hardness Hv at 400° C." is determined for a test material taken from the surface of a forged steel roll for cold rolling by using a high temperature Vickers hardness meter to measure the hardness when raising the temperature from room temperature to 400° C. and holding the material there for 5 minutes. The measurement is performed by a method compliant with JIS Z 2252:1991. More specifically, the test material and indenter are heated, a 5 mm×10 mm measurement surface at a dimension 5 mm×5 mm×10 mm test material is subjected to a load of 300 gf to measure the Vickers hardness at five points, and the average value of these is determined as the Vickers hardness Hv at 400° C. More preferably, the Vickers hardness Hv at 400° C. is 400 or more at an effective diameter region of the roll. The "effective diameter region" means the region from the surface to the minimum diameter enabling rolling (discard diameter).

Shrinkage Start Temperature

As explained previously, to suppress or reduce the initiation of cracks at a roll surface due to thermal shock, it is believed that improving the durability of the roll surface to tensile stress occurring along with shrinkage of the material at a high temperature would be one effective solution. In addition to this, the inventors conducted further studies focusing on the suppression or reduction of the material shrinkage itself at the roll surface at a high temperature and in turn the very generation of tensile stress accompanying such material shrinkage. More specifically, the inventors investigated the correspondence between the temperature at which such shrinkage starts at a roll material (below, referred to as the "shrinkage start temperature") and the initiation of cracks. As a result, the inventors discovered that by using as a roll for cold rolling a roll produced from forged steel having a Vickers hardness Hv at 400° C. of 400 or more and, in addition, having a shrinkage start temperature at the temperature elevation process of 300° C. or more, it is possible to further more remarkably suppress or reduce the initiation of cracks at the roll surface and therefore possible to further more remarkably improve the crack resistance of the roll for cold rolling.

In the present embodiment, the "shrinkage start temperature" means the temperature of an inflexion point (point of time when starting shrinkage) at a low temperature side in a thermal dilatation curve obtained based on the measurement results when measuring the amount of dilatation of a roll material in a temperature elevation process using a Formaster tester.

FIG. 1 is a graph showing thermal dilatation curves of roll materials in a temperature elevation process using a Formaster tester for explaining a shrinkage start temperature according to the present embodiment. The solid line in FIG. 1 shows the thermal dilatation curve of the test material taken from the roll material of Example 3 explained later. The broken line in FIG. 1 shows the thermal dilatation curve of the test material taken from the roll material of Comparative Example 1 explained later. Referring to FIG. 1, in the test material of Comparative Example 1, the slope of change of the amount of dilatation decreases once at 250° C. when raising the temperature from room temperature.

On the other hand, in the test material of Example 3, similarly, at the time of raising the temperature, at a relatively low temperature, the slope of the change of the amount of dilatation does not particularly decrease except for minor fluctuations believed to be measurement error. The slope of the change of the amount of dilatation first decreases once after raising the temperature to the high temperature of 450° C. Such a decrease in slope of change of the amount of dilatation suggests that the material has started shrinking due to the microstructure of the test material being tempered in the temperature elevation process. In the present embodiment, these temperatures are respectively defined as the shrinkage start temperatures relating to the test materials of Comparative Example 1 and Example 3. Referring to FIG. 1, at the thermal dilatation curves relating to the test materials, it is deemed that the slope of change of the amount of dilatation which once fell turns to an increase at the high temperature side from the shrinkage start temperature. It is believed that these temperatures suggest shrinkage due to tempering of the microstructure has finished.

In a forged steel roll for cold rolling according to a preferred embodiment of the present invention, as explained above, the shrinkage start temperature is 300° C. or more. For example, in Example 3 of FIG. 1, the shrinkage start temperature is 450° C. and therefore is extremely high. For this reason, even if slip or sticking or other sheet conveyance problems subject the roll surface to thermal shock and the temperature rises for an instant, it becomes possible to keep shrinkage of the material from occurring at the roll surface or greatly reduce the amount of shrinkage. According to the forged steel roll for cold rolling according to a preferred embodiment of the present invention, compared with a conventional material, it is possible to suppress or reduce the very occurrence of tensile strength accompanying shrinkage of the material at the roll surface, and therefore it becomes possible to remarkably suppress or reduce the initiation of cracks at the roll surface due to such tensile stress.

From the viewpoint of suppressing or reducing the initiation of cracks, the higher the shrinkage start temperature, the better. The shrinkage start temperature may be 350° C. or more, 400° C. or more, 450° C. or more, 500° C. or more, 600° C. or more, 650° C. or more, 670° C. or more, 700° C.

or more, 750° C. or more, 800° C. or more, or 850° C. or more. However, if the shrinkage start temperature reaches too high, the initiation of cracks due to thermal shock would be suppressed or reduced, but sometimes the toughness of the roll would decline. Therefore, for example, the shrinkage start temperature is preferably 950° C. or less.

Preferable Chemical Composition of Forged Steel Roll for Cold Rolling

The forged steel roll for cold rolling of the present embodiment has a 400 or more Vickers hardness Hv at 400° C. and preferably in addition has a 300° C. or more shrinkage start temperature. For this reason, the chemical composition of the forged steel roll for cold rolling may be any chemical composition enabling achievement of a 400 or more Vickers hardness Hv at 400° C. and preferably in addition a 300° C. or more shrinkage start temperature and is not particularly limited. In more detail, the present embodiment, as explained above, has as its object the provision of a forged steel roll for cold rolling improved in crack resistance able to reduce the initiation of cracks due to thermal shock and achieves this object by making the Vickers hardness Hv at 400° C. of the forged steel roll for cold rolling 400 or more and more preferably making the shrinkage start temperature of the forged steel roll for cold rolling 300° C. or more. Therefore, the chemical composition of the forged steel roll for cold rolling is not a technical feature essential for achieving the object of the present embodiment. In the following description, the preferable chemical composition of the forged steel roll for cold rolling for achieving the features of the high temperature hardness and shrinkage start temperature will be explained in detail, but the explanation is intended to simply illustrate the preferable chemical composition of the forged steel roll for cold rolling. It is not intended to limit the present embodiment to a forged steel roll for cold rolling having such a specific chemical composition. In the following explanation, the "%" of the units of contents of the elements included in the forged steel roll for cold rolling unless otherwise indicated means "mass %". Further, in the Description, the "to" showing a numerical range, unless otherwise indicated, is used in the sense including the numerical values before and after it as the lower limit value and upper limit value.

C: 0.70 to 1.50%

Carbon (C) is an element required for increasing the hardness of the roll surface layer. To sufficiently obtain such an effect, the C content is preferably 0.70% or more. The C content may also be 0.75% or more, 0.80% or more, 0.85% or more, or 0.90% or more. On the other hand, if excessively containing C, coarse carbides are formed and sometimes the above effect cannot be sufficiently obtained. Therefore, the C content is preferably 1.50% or less. The C content may also be 1.40% or less, 1.30% or less, 1.20% or less, 1.15% or less, 1.10% or less, 1.05% or less, or 1.00% or less.

Si: 0.40 to 1.50%

Silicon (Si) is an element which generally deoxidizes steel and further improves the hardenability. This time, further, the inventors investigated the relationship between the Si content and the high temperature hardness and shrinkage start temperature of the roll. As a result, they discovered that there is a strong correlation between these and that by adding Si, it is possible to increase both the high temperature hardness and the shrinkage start temperature. From the viewpoint of sufficiently increasing the high temperature hardness of the roll, the Si content is preferably 0.40% or more. On the other hand, from the viewpoint of sufficiently raising the shrinkage start temperature, the Si content is preferably 0.45% or more. The Si content may also be 0.50% or more, 0.60% or more, 0.70% or more, 0.75% or more, 0.80% or more, 0.85% or more, or 0.90% or more. From the viewpoint of increasing the amount of dissolved Si explained in detail later, the Si content is preferably higher. On the other hand, if excessively containing Si, sometimes carbides easily segregate and sufficient toughness cannot be obtained. Therefore, the upper limit value of the Si content is not necessarily limited from the viewpoint of increasing the high temperature hardness and/or shrinkage start temperature of the roll, but from the viewpoint of securing sufficient toughness, the Si content is preferably 1.50% or less. The Si content may also be 1.40% or less, 1.30% or less, 1.20% or less, 1.10% or less, 1.05% or less, 1.00% or less, or 0.95% or less.

While not intending to be bound to any specific theory, by making the Si content higher, it is possible to make the amount of Si present in a dissolved state in the matrix of the roll increase. It is believed it becomes possible to increase the high temperature hardness and shrinkage start temperature of the roll due to such an increase in the amount of dissolved Si. Therefore, even if simply making the Si content increase, if most of it precipitates as carbides, etc., and the amount of Si present in a dissolved state in the matrix of the roll becomes smaller, a sufficient high temperature hardness and/or shrinkage start temperature of the roll are liable to be unable to be obtained. To increase the high temperature hardness and shrinkage start temperature of the roll, in addition to applying a suitable Si content, as explained in detail later, it is extremely important to suitably control the method of production so as to make the amount of Si present in a dissolved state in the matrix increase.

Mn: 0.20 to 1.50%

Manganese (Mn) is an element effectively improve the hardenability. To sufficiently obtain such an effect, the Mn content is preferably 0.20% or more. The Mn content may also be 0.25% or more, 0.30% or more, 0.35% or more, or 0.40% or more. On the other hand, if excessively containing Mn, sometimes sufficient toughness cannot be obtained. Therefore, to effectively improve the hardenability and secure sufficient toughness, the Mn content is preferably 1.50% or less. The Mn content may also be 1.40% or less, 1.20% or less, 1.00% or less, 0.80% or less, or 0.60% or less.

P: 0.030% or Less

Phosphorus (P) is an unavoidably contained impurity. Therefore, the P content is more than 0%. P segregates at the grain boundaries and sometimes the toughness of the steel material decreases. Therefore, the P content is preferably 0.030% or less. The P content may also be 0.025% or less or 0.020% or less. The P content is preferably as low as possible. However, excessive reduction of the P content greatly raises the refining costs in the steelmaking process. Therefore, if considering industrial production, the P content is preferably 0.001% or more. The P content may also be 0.002% or more.

S: 0.0200% or Less

Sulfur (S) is an unavoidably contained impurity. Therefore, the S content is more than 0%. S segregates at the grain boundaries and sometimes the toughness and hot workability of the steel material decrease. Therefore, the S content is preferably 0.0200% or less. The S content may also be 0.0050% or less, 0.0040% or less, or 0.0030% or less. The S content is preferably as low as possible. However, excessive reduction of the S content greatly raises the refining costs in the steelmaking process. Therefore, if considering industrial production, the S content is preferably 0.0001% or more. The S content may also be 0.0002% or more or 0.0003% or more.

Al: 0.050% or Less

Aluminum (Al) is an unavoidably contained impurity. Therefore, the Al content is more than 0%. Al deoxidizes the steel in the steel melting stage. On the other hand, if the Al content is too high, the Al nitrides become coarser and sometimes the toughness of the steel material decreases. Therefore, the Al content is preferably 0.050% or less. The Al content may also be 0.040% or less or 0.030% or less. The Al content may also be 0.001% or more or 0.002% or more. In the Description, the "Al content" means the total Al content in the steel.

N: 0.0200% or Less

Nitrogen (N) is an unavoidably contained impurity. Therefore, the N content is more than 0%. N increases the strength of steel by solution strengthening. On the other hand, if the N content is too high, it forms coarse nitride-based inclusions and sometimes the toughness of the steel material decreases. Therefore, the N content is preferably 0.0200% or less. The N content may also be 0.0150% or less. The N content may also be 0.0001% or more or 0.0002% or more.

O: 0.0050% or Less

Oxygen (O) is an unavoidably contained impurity. Therefore, the O content is more than 0%. O sometimes forms coarse oxide-based inclusions and lowers the toughness of the steel material. Therefore, the O content is preferably 0.0050% or less. The O content may also be 0.0040% or less, 0.0035% or less, or 0.0030% or less. The O content is preferably as low as possible. However, extreme reduction of the O content greatly raises the production costs. Therefore, if considering industrial production, the O content is preferably 0.0001% or more or 0.0005% or more. The O content may also be 0.0007% or more.

Cr: 2.80 to 8.00%

Chrome (Cr) is an element forming carbides and improving the wear resistance. Further, Cr is an element improving the tempering resistance and increasing the high temperature hardness. To sufficiently obtain these effects, the Cr content is preferably 2.80% or more. The Cr content may also be 3.00% or more, 3.20% or more, 3.50% or more, or 4.00% or more. On the other hand, if excessive containing Cr, the carbides coarsen and sometimes the grindability and toughness of the forged steel roll for cold rolling decrease. Therefore, the Cr content is preferably 8.00% or less. The Cr content may also be 7.50% or less, 7.00% or less, 6.50% or less, 6.00% or less, or 5.50% or less.

Mo: 0.30 to 3.00%

Molybdenum (Mo), like Cr, is an element forming carbides and improving the wear resistance. Further, Mo is an element increasing the high temperature hardness by secondary hardening. To sufficiently obtain these effects, the Mo content is preferably 0.30% or more. The Mo content may also be 0.35% or more, 0.40% or more, or 0.45% or more. On the other hand, if excessively containing Mo, the carbides coarsen and sometimes the grindability and toughness of the forged steel roll for cold rolling decrease. Therefore, the Mo content is preferably 3.00% or less. The Mo content may also be 2.80% or less, 2.50% or less, 2.00% or less, 1.80% or less, 1.50% or less, 1.00% or less, 0.80% or less, 0.60% or less or 0.55% or less.

Cu: 0.100% or Less

Copper (Cu) is an unavoidably contained impurity. Therefore, the Cu content is more than 0%. Cu sometimes causes a reduction in the hot workability of steel. Therefore, the Cu content is preferably 0.100% or less. The Cu content may also be 0.095% or less, 0.090% or less, 0.085% or less, 0.080% or less, 0.075% or less, or 0.070% or less. The Cu content is preferably as low as possible. However, excessive reduction of the Cu content raises the production costs. Therefore, the Cu content is preferably 0.001% or more. The Cu content may also be 0.002% or more.

B: 0.0100% or Less

Boron (B) is an unavoidably contained impurity. Therefore, the B content is more than 0%. B sometimes causes a reduction in the toughness of steel. Therefore, the B content is preferably 0.0100% or less. The B content may also be 0.0080% or less or 0.0060% or less. The B content is preferably as low as possible. However, excessive reduction of the B content raises the production costs. Therefore, the B content is preferably 0.0001% or more. The B content may also be 0.0002% or more.

The basic chemical composition of the forged steel roll for cold rolling according to an embodiment of the present invention is as explained above. Further, the forged steel roll for cold rolling may contain one or more of the following elements in accordance with need.

Ni: 0 to 1.20%

Nickel (Ni) is an element improving the hardenability. The Ni content may also be 0%, but to sufficiently obtain such an effect, the Ni content is preferably 0.01% or more. The Ni content may also be 0.05% or more, 0.10% or more, 0.15% or more, or 0.20% or more. On the other hand, if excessively containing Ni, retained austenite is excessively formed and sometimes sufficient hardness can no longer be maintained. Therefore, the Ni content is preferably 1.20% or less. The Ni content may also be 1.10% or less, 1.00% or less, 0.80% or less, 0.60% or less, 0.45% or less, 0.30% or less, 0.28% or less, 0.26% or less, 0.25% or less, or 0.24% or less.

V: 0 to 2.00%

Vanadium (V), like Cr or Mo, is an element forming carbides and improving the wear resistance. Further, V is an element increasing the high temperature hardness by secondary hardening. The V content may also be 0%, but to sufficiently obtain these effects, the V content is preferably 0.01% or more. The V content may also be 0.05% or more, 0.10% or more, 0.15% or more, 0.20% or more, or 0.25% or more. On the other hand, if excessively containing V, the carbides are coarsened and sometimes the grindability and toughness of the forged steel roll for cold rolling decrease. Therefore, the V content is preferably 2.00% or less. The V content may also be 1.80% or less, 1.50% or less, 1.00% or less, 0.80% or less, 0.60% or less, or 0.40% or less.

Nb: 0 to 1.00%

Niobium (Nb), like V and other elements, is an element which bonds with C to form high hardness carbides. Further, Nb is an element increasing the high temperature hardness by secondary hardening. The Nb content may also be 0%, but to sufficiently obtain these effects, the Nb content is preferably 0.01% or more. The Nb content may also be 0.05% or more, 0.10% or more, 0.15% or more, 0.20% or more, or 0.25% or more. On the other hand, if excessively containing Nb, the carbides are coarsened and sometimes the grindability and toughness of the forged steel roll for cold rolling decrease. Therefore, the Nb content is preferably 1.00% or less. The Nb content may also be 0.80% or less, 0.60% or less, or 0.40% or less.

In the forged steel roll for cold rolling according to an embodiment of the present invention, the balance other than the above elements is comprised of Fe and impurities. "Impurities" are constituents, etc., which enter due to various factors in the production process, such as first and foremost the ore, scraps, and other such raw materials, when industrially producing the forged steel roll for cold rolling.

$$[4.50 \leq Cr + Mo + V + Nb \leq 14.00]$$

The chemical composition of the forged steel roll for cold rolling according to an embodiment of the present invention preferably satisfies the following formula 1:

$$4.50 \leq Cr + Mo + V + Nb \leq 14.00 \qquad \text{formula 1}$$

wherein the contents (mass %) of the elements entered in the symbols of the elements in formula 1, and 0 is entered in the case where the elements are not included.

As explained previously, to increase the high temperature hardness and/or shrinkage start temperature of the roll, in addition to modifying the method of production, it is important in particular to control the Si content in the chemical composition to within a predetermined range. However, if just simply controlling the Si content to within a predetermined range, it is difficult to achieve a sufficient high temperature hardness and/or shrinkage start temperature for suppressing or reducing the initiation of cracks at the roll surface. The inventors discovered that by controlling the contents of the elements contained in the roll and in addition further controlling the total content of Cr, Mo, V, and Nb to within a predetermined range, it is possible to more reliably achieve a 400 or more Vickers hardness Hv at 400° C. and a 300° C. or more shrinkage start temperature.

Cr, Mo, V, and Nb, as explained above, are elements forming carbides and improving the wear resistance, etc. If the ratio of carbides contained in the roll is small, the ratio of the matrix material is large, therefore it is believed that the effect of the carbides formed by these elements on the high temperature hardness and/or shrinkage start temperature of the roll is extremely small. However, carbides do not particularly change due to temperature, etc., therefore as their ratio in the roll increase, it is believed that the carbides contribute in direction to increasing the high temperature hardness and/or shrinkage start temperature. In a specific embodiment of the present invention, the contents of the alloy elements contained in the roll are controlled to the previously explained ranges while the total content of Cr, Mo, V, and Nb is controlled to 4.50% or more, therefore Cr+Mo+V+Nb≥4.50. Due to this control, it is possible to form a sufficient amount of carbides in the roll for achieving a 400 or more Vickers hardness Hv at 400° C. and a 300° C. or more shrinkage start temperature. As a result, it becomes possible to remarkably suppress or reduce the initiation of cracks due to thermal shock. The total content of Cr, Mo, V, and Nb may also be 4.80% or more, 5.00% or more, 5.20% or more, 5.50% or more, 5.60% or more, 5.70% or more, 5.80% or more, 6.00% or more, or 6.30% or more.

On the other hand, if the total content of Cr, Mo, V, and Nb is too high, while this does not necessarily have a disadvantageous effect from the viewpoint of increasing the high temperature hardness and shrinkage start temperature, the carbides formed become coarser and sometimes the grindability and toughness of the forged steel roll for cold rolling decrease. Therefore, the total content of the Cr, Mo, V, and Nb is preferably 14.00% or less. For example, the total content of Cr, Mo, V, and Nb may also be 12.00% or less, 10.00% or less, 9.00% or less, 8.50% or less, 8.00% or less, or 7.50% or less.

Method of Producing Forged Steel Roll for Cold Rolling

Next, a preferable method for producing the forged steel roll for cold rolling according to an embodiment of the present invention will be explained. The following explanation is intended to illustrate a characteristic method for producing a forged steel roll for cold rolling according to an embodiment of the present invention and is not intended to limit the forged steel roll for cold rolling to one produced by the method of production explained below.

The preferable method for producing the forged steel roll for cold rolling according to an embodiment of the present invention includes:

- a casting step of casting an ingot from molten steel having the chemical composition explained previously relating to the forged steel roll for cold rolling,
- a forging step of holding the cast ingot at a heating temperature of 1200 to 1300° C. for 10 hours or more, then shaping it into a roll at a forging temperature of 1100 to 1200° C. which is 50 to 150° C. lower than the heating temperature,
- an annealing step of annealing the shaped roll,
- a rough working step of roughly working the obtained roll into the desired roll shape,
- a quenching step of holding the roughly worked roll at a quenching temperature of 900 to 1100° C. for 30 to 180 seconds, then cooling it, wherein the cooling is performed so that the time period until the surface temperature of the roll reaches 800° C. from the quenching temperature is 30 to 300 seconds,
- a tempering step for adjusting the hardness of the roll, and
- a finish working step of working the roll to the final shape by grinding. Below, the steps will be explained in more detail.

Casting Step

In the casting step, an ingot is cast from molten steel having a chemical composition explained previously in relation to the forged steel roll for cold rolling by any suitable casting method known to persons skilled in the art. For example, if the forged steel roll is a one piece roll, the casting method may, for example, be the bottom pouring ingot casting method, etc. Further, the cast ingot may be used as an electrode for performing electroslag remelting (ESR) method, etc., so as to reduce segregation and inclusions. On the other hand, if the forged steel roll is a composite roll comprised of a core material and an outer layer, the casting method may, for example, be the pouring method for cladding or centrifugal casting method, etc.

Forging Step

In the forging step, first, the cast ingot is soaked inside the heating furnace, then is shaped into a roll by forging. In the soaking, the ingot is held at a heating temperature of 1200 to 1300° C., preferably 1250 to 1300° C., for 10 hours or more, preferably 15 hours or more. In the forging, the ingot is shaped into a roll at a forging temperature of 1100 to 1200° C. which is 50 to 150° C., preferably 60 to 100° C., lower than the heating temperature. By performing the soaking under the above conditions, Si-based carbides and other precipitates formed in the forging step easily redissolve at the subsequent annealing step. Due to this, it is possible to secure a sufficient amount of Si present in a dissolved state in the matrix of the roll. By securing a sufficient amount of Si present in a dissolved state in the matrix of the roll, it becomes possible to reliably achieve the desired high temperature hardness and/or shrinkage start temperature in the finally obtained forged steel roll for cold rolling.

The ingot is forged after the above soaking. If the forging temperature at that time is lower than 1100° C., the ingot becomes less ductile and forging cracks are more likely to occur. On the other hand, if the forging temperature is higher than 1200° C., forging cracks accompanying formation of cavities in the roll are more likely to occur. Therefore, to prevent such forging cracks, the forging temperature has to be 1100 to 1200° C. For example, if the temperature of the ingot falls to 900° C. during forging, the ingot is introduced into a heating furnace and heated again until a predetermined forging temperature. After that, the ingot may be taken out from the heating furnace and forged. A drop in such temperature can, for example, be confirmed by measurement using a surface thermometer, etc., or by visual confirmation of changes in color, etc., of the steel surface. Such heating and forging may also be repeated several times. The forging temperature has to be within a range of 1100 to 1200° C. and also has to be suitably selected so that the temperature difference with the heating temperature of 1200 to 1300° C. before forging (heating temperature—forging temperature) is within a range of 50 to 150° C. The reason is that if the temperature difference between the heating temperature and forging temperature becomes too small or too large, Si-based carbides and other precipitates formed in the forging step will easily remain without redissolving even in the subsequent annealing step. From the viewpoint of more reliably reducing the Si-based precipitates, the heating temperature—forging temperature is preferably 60 to 100° C.

Annealing Step and Rough Working Step

The annealing step and rough working step can be performed under any suitable conditions known to persons skilled in the art. While not particularly limited, the annealing step can be performed in an atmosphere furnace, for example, an electric furnace or gas furnace, under suitable conditions for facilitating rough working in the next rough working step. The Si-based precipitates formed at the previous forging step are redissolved at this annealing step. Further, in the rough working step, the roll after the annealing step may, for example, be ground using a grinder so as to roughly work the roll to the desired shape.

Quenching Step

After the rough working step, the surface layer of the body part of the roll is subjected to a quenching step. The quenching step includes holding at a quenching temperature of 900 to 1100° C. for 30 to 180 seconds, then cooling. The cooling is performed at a cooling speed giving a time period until the surface temperature of the roll reaches 800° C. from the quenching temperature of 30 to 300 seconds. By performing the quenching step under such conditions, it is possible to keep the Si redissolved at the annealing step from again precipitating as Si-based precipitates. As a result, it is possible to sufficiently secure an amount of Si present in a dissolved state in the matrix of the roll and, in the finally obtained forged steel roll for cold rolling, the desired high temperature hardness and/or shrinkage start temperature can be reliably achieved. The soaking in the quenching step can be performed using induction heating or any other suitable means. The cooling can be performed by water cooling, etc. Further, in accordance with need or if the amount of retained austenite is particularly great, well-known sub-zero treatment (for example, dipping the roll in a cooling medium to cool it to −60 to −140° C.) is performed on the surface layer of the body part of the roll after the quenching step so as to make the retained austenite transform to martensite.

Tempering Step

After the quenching step, the roll is subjected to a tempering step. In this tempering step, the martensite and bainite formed at a predetermined depth from the surface of the roll body part can be tempered so as to adjust the hardness of the roll. The tempering temperature is preferably 100 to 600° C. The tempering step can be performed in a heating furnace or in an atmosphere furnace, for example, an electric furnace or gas furnace.

Finish Working Step

Finally, after the tempering step, the roll is subjected to a finish working step. In the finish working step, for example, a grinder is used to grind the roll to thereby obtain the desired final roll shape. Further, the forged steel roll for cold rolling according to an embodiment of the present invention having the desired high temperature hardness and/or shrinkage start temperature can be produced.

The forged steel roll for cold rolling according to an embodiment of the present invention can be applied to various types of cold rolling. For example, it can be applied as a work roll in a cold tandem rolling mill comprised of a plurality of rolling stands or a cold reverse rolling mill making the steel move back and forth through a single rolling stand. Further, the forged steel roll for cold rolling according to an embodiment of the present invention can even be applied to skin pass rolling (temper rolling). From the viewpoint of suppressing or reducing the initiation of cracks due to thermal shock, however, it is preferable that the roll be applied as a forged steel roll for cold rolling for other than skin pass rolling.

Below, examples will be used to explain the present invention in more detail. The present invention is not limited to these examples in any way.

EXAMPLES

In the following examples, the forged steel roll for cold rolling according to an embodiment of the present invention was produced under various conditions. The obtained test materials were measured for Vickers hardness Hv at 400° C. and shrinkage start temperature at a temperature elevation process. The relationship between the Vickers hardness Hv and shrinkage start temperature and the initiation of cracks due to thermal shock was investigated.

Production of Forged Steel Roll for Cold Rolling

First, an ingot was cast from molten steel having a chemical composition shown in the following Table 1 by the bottom pouring ingot casting method, then it was treated by the electroslag remelting (ESR) method. Next, the obtained ingot was forged. At the forging step, the ingot was soaked in a heating furnace at the heating temperature and holding time shown in the following Table 1, then the temperature was made to fall to the forging temperature shown in the following Table 1, then the ingot was shaped by forging into a diameter φ700 mm roll body part diameter, body length 2100 mm, and total length 4100 mm roll. If the temperature of the ingot fell to 900° C. during the forging, the ingot was introduced into a heating furnace and heated again to a predetermined forging temperature, then the ingot was taken out from the heating furnace and forged. In accordance with need, such heating and forging were repeated. Next, the roll shaped by the forging was introduced into a gas furnace and held at 900° C. for 10 hours, then was held at 600° C. for 15 hours for annealing. Next, the annealed roll was ground using a grinder so as to roughly work the roll into a roll body diameter φ650 mm, body length 2000 mm, and total length 4000 mm shape.

Next, the roughly worked roll was subjected to a quenching step. At the quenching step. induction heating was used to soak the roll at the quenching temperature and holding time shown in the following Table 1, then the roll was water cooled at a cooling speed giving a time period shown in the following Table 1 until the surface temperature of the roll reached 800° C. from the quenching temperature. After that, the roll was dipped in a cooling medium and cooled to −60 to −140° C. for sub-zero treatment. Next, after the quenching step, the roll was introduced into a heating furnace and tempered at 150° C. Finally, the tempered roll was ground using a grinder to finish the roll into the final shape with a diameter o of the roll body part of 645 mm, body length of 1950 mm, and total length of 3950 mm so as to obtain a forged steel roll for cold rolling. The forged steel roll was measured for Vickers hardness Hv at 400° C. shrinkage start temperature, and cracks due to thermal shock by the methods shown below:

Measurement of Vickers Hardness Hv at 400° C.

Test materials taken from the surfaces of the center parts of the body parts of the forged steel rolls of the examples and comparative examples were measured for hardness using a Nikon QM2 model high temperature Vickers hardness meter when raised in temperature from room temperature to 400° C. and held there for 5 minutes so as to determine the Vickers hardness Hv at 400° C. The measurement was conducted by a method compliant with JIS Z 2252:1991. More specifically, first, a 5 mm×5 mm×10 mm test material was cut out from the surface of the center part of the body part of each of the forged steel rolls. The test material with a thermocouple attached and indenter were heated in vacuum ($3\times10^{-5}$ Torr) from room temperature to 400° C. and held there for 5 minutes. After that, a 5 mm×10 mm measurement surface of the test material was subjected to a load of 300 gf and measured for Vickers hardness at five points. The average value of these was deemed the Vickers hardness Hv at 400° C. The measurement positions of the five points were made five points every 2.5 mm, including the two ends, in a 10 mm direction of the measurement surface (depth direction).

Measurement of Shrinkage Start Temperature

Test materials taken from the surfaces of the center parts of the body parts of the forged steel rolls of the examples and comparative examples were measured for shrinkage start temperature using a Formaster tester (Formaster EDP made by Fuji Electronic Industrial Co., Ltd.) Specifically, first, a dimension φ3 mm×10) mm test material was taken from the surface of the center part of the body part of each of the forged steel rolls. A Formaster tester (Formaster EDP made by Fuji Electronic Industrial Co., Ltd.) was used to measure the amount of dilatation of a 10 mm side when raising the temperature of the test material with the thermocouple attached in a vacuum ($1\times10^{-3}$ Pa) from room temperature by a temperature elevation speed of 180° C./min. The temperature of the inflexion point at the low temperature side in the thermal dilatation curve obtained based on the measurement results (for example, the thermal dilatation curve such as shown in FIG. 1) was found. The obtained value was determined as the shrinkage start temperature of each roll material.

Measurement of Cracks Due to Thermal Shock

Figure 2:
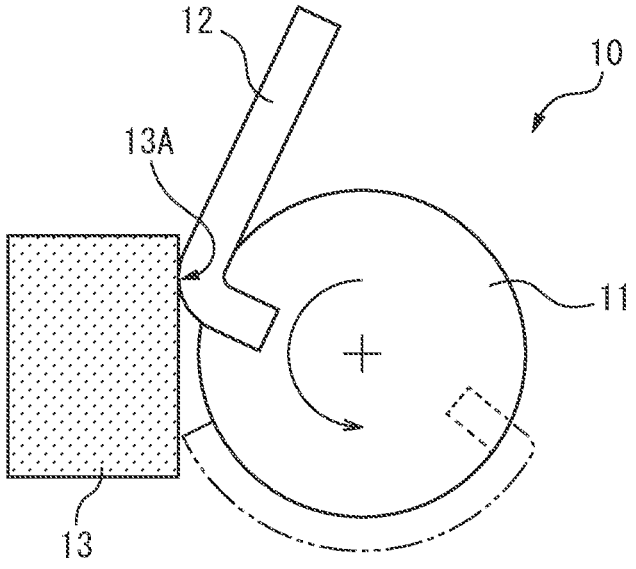
FIG. 2 is a schematic view schematically showing a thermal shock test on different test materials of the examples and comparative examples using a drop weight type friction thermal shock tester.

FIG. 2 is a schematic view schematically showing a thermal shock test on different test materials of the examples and comparative examples using a drop weight type friction thermal shock tester. To evaluate the crack resistance, the drop weight type friction thermal shock tester 10 shown in FIG. 2 was used to conduct a thermal shock test on each of the test materials 13. First, a dimension 20 mm×20 mm×30 mm test material 13 was taken from the surface of the center part of the body part of the forged steel roll. The drop weight type friction thermal shock tester 10 was used to drop a weight on a rack (not shown) so as to make the pinion 11 turn. A diameter 5 mm×length 10 mm biting material 12 comprised of low carbon steel wire rod SWRM6 prescribed in JIS G 3505:2017 was made to contact the 20 mm×30 mm surface 13A strongly in the length direction to give thermal shock to the surface 13A of the test material 13. After the thermal shock test, a cross-section of the contact surface of the test material 13 was examined for the state of crack initiation. The maximum thickness of cracks was used to evaluate the crack resistance. More specifically, a case where the maximum thickness of cracks was less than 400 μm was deemed passing, while a case where the maximum thickness of cracks was 400 μm or more was deemed as failing. The results are shown in the following Table 1.

TABLE 1-1

| | Chemical composition (mass %, balance Fe and impurities) | | | | | | | | | | | | | | | |
|---|---|---|---|---|---|---|---|---|---|---|---|---|---|---|---|---|
| | C | Si | Mn | P | S | Al | N | O | Cr | Mo | Cu | B | Ni | V | Nb | Cr + Mo + V + Nb |
| Comp. Ex. 1 | 0.90 | 0.30 | 0.40 | 0.015 | 0.0010 | 0.020 | 0.0060 | 0.0022 | 5.00 | 0.50 | 0.020 | 0.0002 | | 0.20 | | 5.70 |
| Comp. Ex. 2 | 0.90 | 0.35 | 0.40 | 0.015 | 0.0010 | 0.015 | 0.0054 | 0.0020 | 5.00 | 0.50 | 0.030 | 0.0003 | | 0.20 | | 5.70 |
| Ex. 1 | 0.90 | 0.40 | 0.40 | 0.015 | 0.0010 | 0.016 | 0.0068 | 0.0018 | 5.00 | 0.50 | 0.030 | 0.0001 | | 0.20 | | 5.70 |
| Ex. 2 | 0.90 | 0.45 | 0.40 | 0.016 | 0.0010 | 0.014 | 0.0064 | 0.0015 | 5.00 | 0.50 | 0.030 | 0.0002 | | 0.20 | | 5.70 |
| Ex. 3 | 0.90 | 0.60 | 0.40 | 0.015 | 0.0010 | 0.019 | 0.0034 | 0.0008 | 5.00 | 0.50 | 0.030 | 0.0002 | | 0.20 | | 5.70 |
| Ex. 4 | 0.90 | 0.80 | 0.40 | 0.015 | 0.0010 | 0.016 | 0.0052 | 0.0024 | 5.00 | 0.50 | 0.030 | 0.0003 | | 0.20 | | 5.70 |
| Ex. 5 | 0.90 | 0.90 | 0.40 | 0.011 | 0.0010 | 0.015 | 0.0061 | 0.0023 | 5.00 | 0.50 | 0.040 | 0.0004 | | 0.20 | | 5.70 |
| Ex. 6 | 0.90 | 1.00 | 0.40 | 0.017 | 0.0010 | 0.014 | 0.0083 | 0.0020 | 5.00 | 0.50 | 0.020 | 0.0004 | | 0.20 | | 5.70 |
| Ex. 7 | 0.90 | 1.20 | 0.40 | 0.016 | 0.0010 | 0.011 | 0.0051 | 0.0019 | 5.00 | 0.50 | 0.030 | 0.0003 | | 0.20 | | 5.70 |
| Ex. 8 | 0.75 | 0.60 | 0.40 | 0.011 | 0.0020 | 0.015 | 0.0071 | 0.0017 | 5.00 | 0.70 | 0.030 | 0.0001 | | | | 5.70 |
| Ex. 9 | 1.10 | 0.60 | 0.40 | 0.015 | 0.0010 | 0.014 | 0.0064 | 0.0030 | 5.00 | 0.50 | 0.030 | 0.0004 | 0.30 | 0.20 | | 5.70 |
| Ex. 10 | 0.90 | 0.60 | 0.30 | 0.015 | 0.0010 | 0.020 | 0.0052 | 0.0015 | 2.90 | 0.80 | 0.030 | 0.0002 | | 1.00 | 0.30 | 5.00 |
| Ex. 11 | 0.90 | 0.60 | 1.30 | 0.019 | 0.0010 | 0.014 | 0.0069 | 0.0012 | 6.50 | 0.30 | 0.030 | 0.0003 | | 0.20 | | 7.00 |
| Ex. 12 | 0.90 | 0.60 | 0.40 | 0.017 | 0.0010 | 0.012 | 0.0061 | 0.0018 | 5.00 | 0.50 | 0.030 | 0.0003 | 1.10 | 0.20 | | 5.70 |
| Ex. 13 | 0.90 | 0.60 | 0.40 | 0.016 | 0.0010 | 0.024 | 0.0059 | 0.0032 | 4.50 | 0.50 | 0.040 | 0.0002 | | 0.20 | | 5.20 |
| Ex. 14 | 0.90 | 0.60 | 0.40 | 0.015 | 0.0020 | 0.020 | 0.0056 | 0.0012 | 4.70 | 0.50 | 0.030 | 0.0002 | | 0.30 | | 5.50 |
| Ex. 15 | 0.90 | 1.40 | 0.40 | 0.019 | 0.0010 | 0.019 | 0.0046 | 0.0020 | 5.00 | 0.50 | 0.020 | 0.0001 | | 0.20 | | 5.70 |
| Ex. 16 | 0.90 | 0.60 | 0.40 | 0.019 | 0.0010 | 0.012 | 0.0051 | 0.0028 | 5.00 | 2.70 | 0.030 | 0.0003 | | 0.20 | | 7.90 |
| Ex. 17 | 1.20 | 0.60 | 0.40 | 0.013 | 0.0020 | 0.024 | 0.0060 | 0.0015 | 6.30 | 1.90 | 0.030 | 0.0002 | 0.40 | 0.80 | 0.40 | 9.40 |
| Ex. 18 | 1.25 | 0.60 | 0.40 | 0.017 | 0.0010 | 0.023 | 0.0067 | 0.0028 | 6.80 | 2.30 | 0.020 | 0.0004 | 0.50 | 1.30 | 0.50 | 10.90 |
| Ex. 19 | 1.35 | 0.60 | 0.40 | 0.018 | 0.0020 | 0.016 | 0.0064 | 0.0030 | 7.40 | 2.70 | 0.030 | 0.0002 | 0.70 | 1.80 | 0.70 | 12.60 |
| Ex. 20 | 1.45 | 0.60 | 0.40 | 0.010 | 0.0020 | 0.022 | 0.0055 | 0.0030 | 8.00 | 3.00 | 0.030 | 0.0002 | 0.90 | 2.00 | 1.00 | 14.00 |
| Ex. 21 | 0.90 | 0.60 | 0.40 | 0.016 | 0.0010 | 0.018 | 0.0055 | 0.0025 | 5.00 | 0.50 | 0.040 | 0.0003 | | | | 5.50 |
| Ex. 22 | 1.20 | 0.60 | 0.40 | 0.018 | 0.0010 | 0.012 | 0.0076 | 0.0016 | 6.30 | 1.90 | 0.030 | 0.0002 | 0.40 | | 0.40 | 8.60 |
| Comp. Ex. 3 | 0.90 | 0.60 | 0.40 | 0.019 | 0.0010 | 0.014 | 0.0058 | 0.0013 | 3.50 | 0.50 | 0.030 | 0.0001 | | 0.20 | | 4.20 |
| Comp. Ex. 4 | 0.90 | 0.60 | 0.40 | 0.018 | 0.0010 | 0.016 | 0.0064 | 0.0017 | 5.00 | 0.50 | 0.030 | 0.0002 | | 0.20 | | 5.70 |
| Comp. Ex. 5 | 0.90 | 0.60 | 0.40 | 0.014 | 0.0010 | 0.016 | 0.0060 | 0.0018 | 5.00 | 0.50 | 0.030 | 0.0004 | | 0.20 | | 5.70 |
| Comp. Ex. 6 | 0.90 | 0.60 | 0.40 | 0.013 | 0.0010 | 0.016 | 0.0060 | 0.0015 | 5.00 | 0.50 | 0.030 | 0.0003 | | 0.20 | | 5.70 |
| Comp. Ex. 7 | 0.90 | 0.60 | 0.40 | 0.017 | 0.0010 | 0.014 | 0.0067 | 0.0020 | 5.00 | 0.50 | 0.030 | 0.0005 | | 0.20 | | 5.70 |
| Comp. Ex. 8 | 0.90 | 0.60 | 0.40 | 0.025 | 0.0010 | 0.017 | 0.0055 | 0.0021 | 5.00 | 0.50 | 0.030 | 0.0002 | | 0.20 | | 5.70 |
| Comp. Ex. 9 | 0.90 | 0.60 | 0.40 | 0.017 | 0.0010 | 0.018 | 0.0052 | 0.0018 | 5.00 | 0.50 | 0.030 | 0.0002 | | 0.20 | | 5.70 |
| Comp. Ex. 10 | 0.90 | 0.60 | 0.40 | 0.020 | 0.0010 | 0.018 | 0.0055 | 0.0017 | 5.00 | 0.50 | 0.050 | 0.0005 | | 0.20 | | 5.70 |
| Comp. Ex. 11 | 0.90 | 0.60 | 0.40 | 0.019 | 0.0010 | 0.015 | 0.0044 | 0.0028 | 5.00 | 0.50 | 0.030 | 0.0002 | | 0.20 | | 5.70 |
| Comp. Ex. 12 | 0.90 | 0.60 | 0.40 | 0.015 | 0.0010 | 0.019 | 0.0052 | 0.0026 | 5.00 | 0.50 | 0.050 | 0.0006 | | 0.20 | | 5.70 |
| Comp. Ex. 13 | 0.90 | 0.60 | 0.40 | 0.011 | 0.0010 | 0.010 | 0.0051 | 0.0022 | 5.00 | 0.50 | 0.020 | 0.0001 | | 0.20 | | 5.70 |
| Comp. Ex. 14 | 0.90 | 0.60 | 0.40 | 0.020 | 0.0010 | 0.014 | 0.0048 | 0.0014 | 5.00 | 0.50 | 0.020 | 0.0002 | | 0.20 | | 5.70 |
| Comp. Ex. 15 | 0.90 | 1.40 | 0.40 | 0.019 | 0.0010 | 0.018 | 0.0053 | 0.0011 | 5.00 | 0.50 | 0.030 | 0.0002 | | 0.20 | | 5.70 |

TABLE 1-2

Table 1-2

| | Forging step | | | | Quenching step | | | | | |
|---|---|---|---|---|---|---|---|---|---|---|
| | Heating temp. (A) ° C. | Holding time hrs | Forging temp. (B) ° C. | (A-B) | Quenching temp. ° C. | Holding time sec | Time period until 800° C. from quenching temp. sec | Vickers hardness Hv at 400° C. | Shrinkage start temp. ° C. | Max. depth of cracks μm |
| Comp. Ex. 1 | 1250 | 15 | 1180 | 70 | 1000 | 120 | 100 | 370 | 250 | 450 |
| Comp. Ex. 2 | 1250 | 15 | 1180 | 70 | 1000 | 120 | 100 | 385 | 280 | 410 |
| Ex. 1 | 1250 | 15 | 1180 | 70 | 1000 | 120 | 100 | 400 | 290 | 390 |
| Ex. 2 | 1250 | 15 | 1180 | 70 | 1000 | 120 | 100 | 410 | 300 | 300 |
| Ex. 3 | 1250 | 15 | 1180 | 70 | 1000 | 120 | 100 | 420 | 450 | 250 |
| Ex. 4 | 1250 | 15 | 1180 | 70 | 1000 | 120 | 100 | 430 | 600 | 210 |
| Ex. 5 | 1250 | 15 | 1180 | 70 | 1000 | 120 | 100 | 435 | 670 | 180 |
| Ex. 6 | 1250 | 15 | 1180 | 70 | 1000 | 120 | 100 | 440 | 750 | 160 |
| Ex. 7 | 1250 | 15 | 1180 | 70 | 1000 | 120 | 100 | 450 | 850 | 150 |
| Ex. 8 | 1250 | 15 | 1180 | 70 | 1000 | 120 | 100 | 410 | 430 | 270 |
| Ex. 9 | 1250 | 15 | 1180 | 70 | 1000 | 120 | 100 | 420 | 460 | 240 |
| Ex. 10 | 1250 | 15 | 1180 | 70 | 1000 | 120 | 100 | 425 | 500 | 230 |
| Ex. 11 | 1250 | 15 | 1180 | 70 | 1000 | 120 | 100 | 430 | 550 | 220 |
| Ex. 12 | 1250 | 15 | 1180 | 70 | 1000 | 120 | 100 | 420 | 450 | 250 |
| Ex. 13 | 1250 | 15 | 1180 | 70 | 1000 | 120 | 100 | 410 | 340 | 320 |
| Ex. 14 | 1250 | 15 | 1180 | 70 | 1000 | 120 | 100 | 415 | 380 | 310 |
| Ex. 15 | 1250 | 15 | 1180 | 70 | 1000 | 120 | 100 | 455 | 900 | 140 |

TABLE 1-2-continued

Table 1-2

| | Forging step | | | | Quenching step | | | | | |
|---|---|---|---|---|---|---|---|---|---|---|
| | Heating temp. (A) ° C. | Holding time hrs | Forging temp. (B) ° C. | (A-B) | Quenching temp. ° C. | Holding time sec | Time period until 800° C. from quenching temp. sec | Vickers hardness Hv at 400° C. | Shrinkage start temp. ° C. | Max. depth of cracks μm |
| Ex. 16 | 1250 | 15 | 1180 | 70 | 1000 | 120 | 100 | 425 | 500 | 240 |
| Ex. 17 | 1250 | 15 | 1180 | 70 | 1000 | 120 | 100 | 425 | 455 | 240 |
| Ex. 18 | 1250 | 15 | 1180 | 70 | 1000 | 120 | 100 | 425 | 460 | 240 |
| Ex. 19 | 1250 | 15 | 1180 | 70 | 1000 | 120 | 100 | 430 | 465 | 230 |
| Ex. 20 | 1250 | 15 | 1180 | 70 | 1000 | 120 | 100 | 430 | 475 | 220 |
| Ex. 21 | 1250 | 15 | 1180 | 70 | 1000 | 120 | 100 | 415 | 420 | 260 |
| Ex. 22 | 1250 | 15 | 1180 | 70 | 1000 | 120 | 100 | 420 | 445 | 250 |
| Comp. Ex. 3 | 1250 | 15 | 1180 | 70 | 1000 | 120 | 100 | 395 | 270 | 420 |
| Comp. Ex. 4 | 1170 | 15 | 1100 | 70 | 1000 | 120 | 100 | 350 | 230 | 470 |
| Comp. Ex. 5 | 1330 | 15 | 1180 | 150 | 1000 | 120 | 100 | 385 | 280 | 405 |
| Comp. Ex. 6 | 1250 | 7 | 1180 | 70 | 1000 | 120 | 100 | 330 | 210 | 500 |
| Comp. Ex. 7 | 1230 | 15 | 1200 | 30 | 1000 | 120 | 100 | 305 | 190 | 530 |
| Comp. Ex. 8 | 1280 | 15 | 1100 | 180 | 1000 | 120 | 100 | 340 | 220 | 490 |
| Comp. Ex. 9 | 1250 | 15 | 1180 | 70 | 880 | 120 | 100 | 290 | 180 | 550 |
| Comp. Ex. 10 | 1250 | 15 | 1180 | 70 | 1120 | 120 | 100 | 315 | 200 | 510 |
| Comp. Ex. 11 | 1250 | 15 | 1180 | 70 | 1000 | 15 | 100 | 335 | 210 | 495 |
| Comp. Ex. 12 | 1250 | 15 | 1180 | 70 | 1000 | 210 | 100 | 360 | 230 | 460 |
| Comp. Ex. 13 | 1250 | 15 | 1180 | 70 | 1000 | 120 | 10 | 370 | 260 | 440 |
| Comp. Ex. 14 | 1250 | 15 | 1180 | 70 | 1000 | 120 | 350 | 300 | 180 | 550 |
| Comp. Ex. 15 | 1180 | 15 | 1110 | 70 | 1000 | 120 | 100 | 380 | 260 | 430 |

In the present examples, if the maximum thickness of cracks was less than 400 μm, a roll was evaluated as a forged steel roll for cold rolling with an improved crack resistance. Referring to Table 1, in each of Comparative Examples 1 to 15, the desired high temperature hardness and shrinkage start temperature could not be obtained, the maximum thickness of cracks became 400 μm or more, and a sufficient crack resistance could not be achieved. In particular, in each of Comparative Examples 4 to 6, the heating temperature at the forging step was not suitable or the holding time was short, therefore it is believed that a sufficient amount of Si present in the dissolved state in the matrix of the roll could not be secured. As a result, the desired high temperature hardness and shrinkage start temperature could not be obtained, the maximum thickness of cracks became 400 μm or more, and sufficient crack resistance could not be achieved. In each of Comparative Examples 7 and 8, the temperature difference between the heating temperature and the forging temperature at the forging step (heating temperature-forging temperature) was not suitable, therefore it is believed the Si-based precipitates formed at the forging step could not be made to be sufficiently redissolved at the subsequent annealing step. As a result, the desired high temperature hardness and shrinkage start temperature could not be obtained, the maximum thickness of cracks became 400 μm or more, and sufficient crack resistance could not be achieved. In each of Comparative Examples 9 to 14, the quenching temperature, the holding time, or the time period until reaching 800° C. from the quenching temperature at the quenching step was not suitable, so it is believed the Si redissolving at the annealing step precipitating as the Si-based precipitates again at the quenching step could not be sufficiently suppressed. As a result, the desired high temperature hardness and shrinkage start temperature could not be obtained, the maximum thickness of cracks became 400 μm or more, and a sufficient crack resistance could not be achieved. Comparative Example 15 had an Si content of a relatively high 1.40% yet despite this, the heating temperature at the forging step was not suitable, therefore it is believed that a sufficient amount of Si present in a dissolved state in the matrix of the roll could not be secured. As a result, the desired high temperature hardness and shrinkage start temperature could not be obtained, the maximum thickness of cracks became 400 μm or more, and a sufficient crack resistance could not be obtained.

In contrast to this, in each of Examples 1 to 22 with a Vickers hardness Hv at 400° C. of 400 or more, the maximum thickness of cracks became 390 μm or less and, compared with Comparative Examples 1 to 15, a high crack resistance could be achieved. In each of Examples 2 to 22 with a shrinkage start temperature of 300° C. or more, the maximum thickness of cracks became 320 μm or less and, compared with Example 1, the crack resistance could be further improved. In particular, each of Examples 5 to 7 and 15 with a Vickers hardness Hv at 400° C. of 435 or more (and a shrinkage start temperature of 670° C. or more) had a maximum thickness of cracks of less than 200 μm and could achieve an extremely high crack resistance.

REFERENCE SIGNS LIST

10. drop weight type friction thermal shock tester
11. pinion
12. biting material
13. test material
13A. surface of test material

The invention claimed is:

1. A forged steel roll for cold rolling with a Vickers hardness Hv at 400° C. of 400 or more, having a chemical composition comprising, by mass %, C: 0.70 to 1.50%,
Si: 0.40 to 1.50%.
Mn: 0.20 to 1.50%,
P: 0.030% or less,
S: 0.0200% or less,
Al: 0.050% or less,
N: 0.0200% or less,
O: 0.0050% or less,
Cr: 2.80 to 8.00%,
Mo: 0.30 to 3.00%,
Cu: 0.100% or less,
B: 0.0100% or less,
Ni: 0 to 1.20%,
V: 0 to 2.00%.
Nb: 0 to 1.00%, and
balance: Fe and impurities, and
satisfying the following formula 1:

$$4.50 \leq Cr + Mo + V + Nb \leq 14.00 \quad \text{formula 1}$$

wherein the contents (mass %) of the elements entered in the symbols of the elements in formula 1, and 0 is entered in the case where the elements are not included.

2. The forged steel roll for cold rolling according to claim 1, wherein the chemical composition contains, by mass %, at least one of Ni: 0.05 to 1.20%,
V: 0.10 to 2.00%, and
Nb: 0.10 to 1.00%.

3. The forged steel roll for cold rolling according to claim 2, wherein a shrinkage start temperature in a temperature elevation process is 300° C. or more.

4. The forged steel roll for cold rolling according to claim 1, wherein a shrinkage start temperature in a temperature elevation process is 300° C. or more.

* * * * *